United States Patent [19]

Ambrosini et al.

[11] B 3,981,241

[45] Sept. 21, 1976

[54] SELF-LEVITATING SIGNAL CARTRIDGE

[75] Inventors: Leonard R. Ambrosini, Churchville, Md.; Raymond S. Isenson, Vandenberg AFB, Calif.

[73] Assignee: The United States of America as represented by the Secretary of the Army, Washington, D.C.

[22] Filed: Oct. 11, 1973

[21] Appl. No.: 405,726

[44] Published under the second Trial Voluntary Protest Program on January 13, 1976 as document No. B 405,726.

[52] U.S. Cl. ..... 102/32; 102/34; 102/49.7; 102/99

[51] Int. Cl.[2] ..... F42B 4/06; F42B 4/26

[58] Field of Search ..... 102/32, 34.1, 34, 34.2, 102/34.3, 34.4, 34.5, 49.3, 49.4, 49.7, 99, 103, 37.8; 60/35.6 RS

[56] References Cited

UNITED STATES PATENTS

| | | | |
|---|---|---|---|
| 1,947,834 | 2/1934 | Driggs, Jr. et al. | 102/32 |
| 2,489,953 | 11/1949 | Burney | 102/49.7 |
| 2,644,364 | 7/1953 | Nass | 102/49.7 X |
| 3,023,570 | 3/1962 | Crouch | 102/103 X |
| 3,245,350 | 4/1966 | Kelly | 102/65.2 X |
| 3,750,574 | 8/1973 | Lohkamp | 102/32 |

*Primary Examiner*—Samuel Feinberg
*Assistant Examiner*—C. T. Jordan
*Attorney, Agent, or Firm*—Nathan Edelberg

[57] ABSTRACT

A pyrotechnic signal cartridge comprising a cartridge case, a projectile case detachably secured to the cartridge case, a charge in the cartridge case for launching the projectile case, rocket motor thrust means positioned within the projectile case, a rocket motor propellant charge and a pyrotechnic signal charge in the projectile case, ignition means for the pyrotechnic signal charge and the rocket motor propellant charge whereby ignition of the pyrotechnic signal charge and the rocket motor propellant charge after launching of the projectile case provides a self-levitating pyrotechnic display.

2 Claims, 5 Drawing Figures

SELF-LEVITATING SIGNAL CARTRIDGE

The invention described herein may be manufactured and used by or for the government for governmental purposes without the payment of any royalties thereon or therefor.

This invention relates to a pyrotechnic signal cartridge such as an aerial flare, and more particularly, relates to a self-levitating pyrotechnic signal cartridge.

BACKGROUND AND OBJECTS

Prior art signal cartridges are usually launched from shoulder or hand-fired weapons, and utilize a parachute type canopy to suspend and retard the descent of the cartridge or flare to prolong the pyrotechnic display. Without such a parachute, the light-producing payload would fall rapidly back to the ground, and the light display would be rather shortlived.

Even with the use of a parachute, the pyrotechnic display does not have as great a duration as would be desirable since space, which could otherwise be used for increased payload, is required to accommodate the parachute within the restricted confines of the cartridge or projectile body.

Furthermore, unreliable deployment of the parachute at the prescribed height frequently renders the signal ineffective. Such so-called "duds" are of course costly and time consuming.

Prior art efforts to overcome these disadvantages have centered on improved parachute deployment or larger cartridges for larger payloads. However, generally cartridges in the 30–50 millimeter range are the maximum size used for hand-held weapons.

Accordingly, a primary object of this invention is to eliminate the need for a parachute for suspending the signal display.

Another object of this invention is to provide a self-levitating signal cartridge.

A further object of this invention is to provide a signal cartridge having thrust means for levitating the cartridge.

Still another object of this invention is to provide a self-levitating signal cartridge which may incorporate a larger payload than previously used within the same size cartridge.

Still a further object of this invention is to provide a self-levitating signal cartridge which utilizes a payload which will simultaneously provide a signal and a means for suspending that signal using the same mass of material.

Yet another object of this invention is to provide a signal cartridge which incorporates separate solid masses of material to yield levitation and a light or smoke signal within the same cartridge.

A still further object of this invention is to provide a signal cartridge which utilizes a rocket motor for levitating the cartridge at or near the zenith of its trajectory.

Yet a further object of this invention is to provide a self-levitating signal cartridge having thrust producing means which is balanced over time with respect to the mass of the signal cartridge.

A still further object of this invention is to provide a signal cartridge utilizing a rocket motor for levitating the signal cartridge and including a self-compensating thrust modulator for the rocket motor.

Still another object of this invention is to provide a signal cartridge which utilizes a configured thrust-producing charge for balancing the thrust output with respect to the mass of the projectile over time.

These and other objects and advantages of this invention will become apparent when considered in light of the following description and claims when taken together with the accompanying drawings, in which:

DESCRIPTION OF THE EMBODIMENT OF FIGS. 1 AND 2

Figures 1, 2, 3, 4, 5:
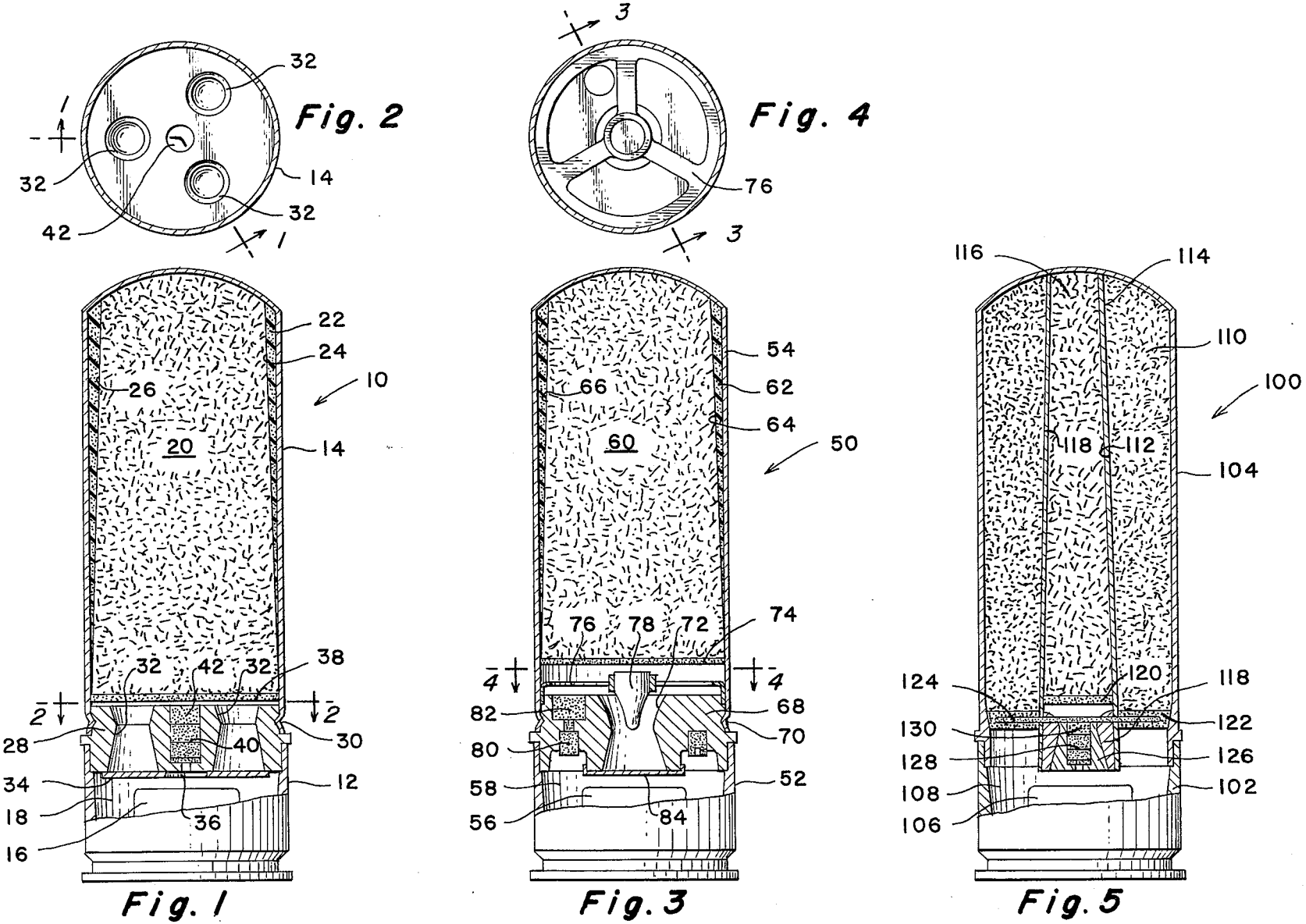
FIG. 1 is a view partly in section of one embodiment of this invention and taken along line 1—1 of FIG. 2.
FIG. 2 is a sectional view along line 2—2 of FIG. 1 and viewed in the direction of the arrows.
FIG. 3 is a longitudinal view partly in section of another embodiment of this invention.
FIG. 4 is a sectional view along line 4—4 of FIG. 3 and viewed in the direction of the arrows.
FIG. 5 is a view partly in section of still another embodiment of this invention.

In FIGS. 1 and 2, a signal cartridge generally designated 10 is seen to comprise a cartridge casing 12 and a projectile casing 14. The projectile case 14 is detachably secured to the cartridge case 12 by conventional means such as swaging or the like.

The cartridge case 12 includes a primer 16 and a launching charge 18 similar to conventional signal cartridges. The launching charge is utilized for launching the projectile case 14 to the desired height.

Within the projectile case 14, is a combined thrust-producing charge composition and pyrotechnic display composition and identified as 20. Positioned around the charge composition 20 and within the wall of the projectile case 14 is an inert ballast material 22. Preferably, the interior surface or wall 24 of the ballast has a conical configuration tapering inwardly in an upward direction as seen in FIG. 1. Similarly, the charge 20 would have a correspondingly configured external surface 26.

Positioned within the lower portion of the projectile case 14 is a body 28 which is held in place by means of swaging 30. Body 28 has a plurality of rocket motor nozzles 32 formed therein. Any suitable number of such nozzles may be provided, however, three nozzles have been found appropriate for this embodiment.

Positioned beneath the body 28 is a suitable closure disc 34 having a central aperture 36.

Positioned between the upper end of the rocket nozzles 32 and the lower end of the charge 20 is an ignition composition 38. Centrally positioned between the ignition composition 38 and the aperture 36 is a pyrotechnic delay column 40 and a first fire ignition mixture 42.

In operation, the projectile case carrying the rocket motor nozzles 32 and the charge 20 is propelled vertically from the gun tube by the cartridge case propellant charge 18 which imparts spin and velocity to the projectile. In addition to launching the projectile, the launching charge 18 ignites the pyrotechnic delay column 40 in the base of the projectile. The nozzle closure ring 34 prevents the propellant gases from entering the interior of the rocket motor chamber. The time of the delay column is fixed to provide ignition of the first fire mixture 42 and the ignition mixture 38 which in turn ignites the rocket motor at or near the zenith of the trajectory. Burning of the combination propellant/illumination producing pyrotechnic charge 20 yields gas and burning particles of the pyrotechnic mixture in the exhaust plume vented through the nozzle ports to provide the illumination signal. The suspension or levitation of the signal is achieved by balancing the thrust level of the rocket motor nozzles 32 against the total mass of the rocket projectile at any given time during the burning of the charge 20. This is accomplished by configuring the end burning charge in combination with the nozzle ports to yield a regressive thrust over the burn time. This is, the thrust level is greatest at the beginning of the burn when the total mass of the projectile is the greatest, and the thrust level decreases during the burn time as the total mass decreases because of the consumed charges. The conical shape of the charge 20 is a typical charge configuration which could yield the regressive thrust versus time as desired. The end burning, conical shape charge will provide the decrease in burning surface area and consequently a decreasing thrust level over the burn time.

A suitable composition of the combined thrust generating propellant-pyrotechnic mixture identified as 20 in FIG. 1 is given in the following Table I:

TABLE I

| COMPOUND | WEIGHT % RANGE | WEIGHT % PREFERRED |
|---|---|---|
| Magnesium powder | 25–45% | 35% |
| Sodium nitrate | 35–45% | 40% |
| Polyvinyl Chloride binder-fuel comp. | 20–30% | 25% |

In general, the preparation of this composition is accomplished by simple dry blending. Oxide salts such as sodium nitrate are generally oven dried before being incorporated into the mixture to avoid the inclusion of excess moisture into the mixture prior to charging into the projectile body. Double cone blenders are generally used for the dry blending process. Where possible, blending rooms are controlled at humidity levels below the critical humidity at which the specific ingredient begins to take on moisture.

The composition of the ignition mixture 38 is essentially a standard composition, and is given in Table II:

TABLE II

| COMPOUND | WEIGHT % |
|---|---|
| Boron | 18.5 |
| Barium chromate | 37.5 |
| Potassium nitrate | 33.5 |
| Aluminum powder | 6.5 |
| Resin binder (polyvinyl alcohol/ acetate resin, also known as VAAR) | 4.0 |

The composition of the first fire ignition mixture 42 is also standard, and is given in Table III:

TABLE III

| COMPOUND | WEIGHT % |
|---|---|
| Molybdenum trioxide | 25 |
| Zirconium powder | 58 |
| Chromic oxide | 16 |
| Resin binder | 1 |

DESCRIPTION OF EMBODIMENT OF FIGS. 3 AND 4

An alternate embodiment is illustrated in FIGS. 3 and 4 wherein a signal cartridge generally designated 50 is seen to comprise a cartridge casing 52 and a projectile case 52. A primer 56 and launching charge 58 are provided in the cartridge case 52 which is detachably secured to the projectile case 54. A combined thrust-producing pyrotechnic signal charge composition 60 is provided and is substantially the same as the composition set out in Table I. An inert ballast material 62 is provided similarly to the ballast material 22 of FIG. 1, thusly having a tapered inner surface 64 while the exterior surface of the charge 60 has a correspondingly tapered exterior surface 66. This conical configuration of the charge 60 produces the regressive thrust similarly to FIG. 1.

A body 68 is crimped and sealed into the projectile case 54 as seen at 70, and is provided with a single, centrally disposed rocket motor nozzle 72. An ignition mixture charge 74 is provided at the lower portion of the charge mixture 60.

Positioned between the body 68 and the ignition charge 74 is a spring 76 having the configuration best seen in FIG. 4. The spring 76 is generally formed in the shape of a spoked wheel, and has a hub member 78 supported thereby. The member 78 has a shape best seen in FIG. 3 and depends into the rocket motor nozzle 72.

Positioned within the body 68 is an annular delay column 80 in direct contact with the first fire ignition charge 82. The ignition charge 74 and the first fire mixture charge 82 are the same as the compositions given in Tables II and III respectively.

A cover 84 is detachably secured over the lower end of the rocket nozzle 72 to prevent gases from the launching charge 58 from entering the rocket nozzle.

In operation, the launching charge 58 ignites the delay column 80 in a manner similar to that described in connection with FIG. 1. The delay column in turn ignites the first fire mixture 82 which in turn ignites the thrust generating and pyrotechnic charge mixture 60. The ignition of the charge 60 generates gases which pass downwardly through the rocket motor nozzle 72 to produce a levitation of the projectile case 54. Thus far, the operation is similar to that described in connection with FIG. 1. However, in this embodiment, when the projectile 54 is up in the air, any downward acceleration or dropping of the projectile 54 imparts an upward acceleration to the spring mounted member 78, the movement of which increases the nozzle port area and consequently the gas flow through the nozzle thereby increasing the thrust to maintain levitation of the signal. Conversely, upward acceleration due to increased thrust will impart a downward acceleration to the spring loaded mass thereby decreasing the nozzle port area and decreasing the thrust again to maintain levitation of the signal. This self-compensating thrust modulation serves to maintain the projectile 54 and thus the pyrotechnic display at a constant elevation.

DESCRIPTION OF THE EMBODIMENT OF FIG. 5

Another alternate embodiment is shown in FIG. 5 wherein the cartridge generally designated 100 is seen to include a cartridge case 102 and a projectile case 104. A primer 106 and launching charge 108 is also provided. The projectile case 104 is detachably secured to the cartridge case 102 as by crimping, for example. In this embodiment, a pyrotechnic light or smoke display charge 110 is provided and has a tubular configuration with a conical inward wall 112. A tube 114 is provided as a spacer, and within tube 114 is a propellant charge 116 which has a conical exterior wall 118 corresponding to wall 112.

Positioned within the lower portion tube 114 is a rocket motor nozzle 118. Between the nozzle 118 and the propellant charge 116 is the propellant ignition mixture 120.

An annular pyrotechnic charge igniting mixture 122 surrounds the outer portion of the lower end of tube 114, and contains an igniter cord 124 extending laterally therethrough.

Positioned within the nozzle 118 is a plug 126 which carries a delay column 128 and the first fire ignition mixture 130.

The operation of this embodiment is similar to the embodiment previously described except that the delay column 128 simultaneously ignites the first fire mix 130, igniter cord 124, and the rocket motor ignition mixture 120. Upon ignition of the rocket motor, the nozzle plug 126 is blown free and ignition of the payload is effected by the igniter cord 124 through the ignition mixture 122. The rocket motor provides the suspension or levitation of the signal similar to the method described in the previous embodiment. The pyrotechnic payload 110 burns simultaneously with the rocket motor propulsion charge 116 and provides either a light or smoke signal. The conical configuration of the charge 116 provides the regressive thrust as previously discussed.

In this embodiment, the composition of the propellant charge is generally standard and is given in Table IV:

TABLE IV

| COMPOUND | WEIGHT % |
|---|---|
| Ammonium nitrate | 60.85 |
| Cellulose acetate | 11.05 |
| Acetyl triethyl citrate | 10.80 |
| Dinitrophenoxy ethanol | 10.30 |
| Sodium barbiturate | 3.00 |
| Carbon black | 3.00 |
| Toluene diamine | 0.90 |
| Phenyl morpholine | 0.10 |

If a pyrotechnic light signal is desired, a suitable composition for the flare mixture would be as given in Table V:

TABLE V

| COMPOUND | WEIGHT % |
|---|---|
| Magnesium powder | 42 |
| Sodium nitrate | 50 |
| Polyvinyl chloride (binder fuel-comp) | 8 |

Alternatively, if a smoke signal is desired, instead of the light signal, the pyrotechnic composition 110 could be substantially as set out in Table VI:

TABLE VI

| COMPOUND | WEIGHT % |
|---|---|
| Potassium chlorate | 31 |
| Sugar | 20 |
| Dye | 47 |
| Resin binder (vinyl alcohol acetate resin) | 2 |

The ignition mixture and first fire mixture could be substantially as set out in Tables II and III.

While this invention has been described, it will be understood that it is capable of further modification, and this application is intended to cover any variations, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What we claim is:

1. In a pyrotechnic signal cartridge comprising:

a. a cartridge case, b. a projectile case detachably secured to said cartridge case, c. a projectile initial propulsion charge in said cartridge case for launching said projectile case, d. a rocket motor means, including a plurality of rocket nozzle ports, closure means for said ports positioned within said projectile case, a solid pyrotechnic signal composition, and a solid rocket motor propellant composition, e. ignition means including an ignition composition and a delay column for said solid pyrotechnic signal composition and said solid rocket motor propellant composition, wherein the improvement comprises, said solid rocket motor propellant composition and said solid pyrotechnic signal composition present in admixture in said projectile case and wherein said compositions present in admixture have a conical configuration with diameter gradually decreasing with distance from said rocket nozzle parts such that burning of said compositions in admixture after launching of said projectile case balances the thrust of the rocket motor means against the mass of the cartridge providing a thrust-to-weight ratio of approximately unity which effect causes a self levitating display.

2. A signal cartridge as in claim 1 and wherein:

a. said rocket motor means comprises three radially arranged equally spaced rocket nozzle ports, and b. said delay column being centrally positioned between said rocket nozzle ports.

* * * * *